US005364147A

United States Patent [19]

Dickey et al.

[11] Patent Number: 5,364,147

[45] Date of Patent: Nov. 15, 1994

[54] DEVICE FOR HANDLING RAILROAD TIMBER

[75] Inventors: Thomas E. Dickey, Manchester, Mo.; Thomas Y. Gehr, Jr., Northbrook, Ill.

[73] Assignee: ESCO Equipment Service Company, Palatine, Ill.

[21] Appl. No.: 30,598

[22] Filed: Mar. 11, 1993

[51] Int. Cl.[5] ..... B66C 1/32

[52] U.S. Cl. ..... 294/118; 294/117; 294/902

[58] Field of Search ..... 294/16, 81.61, 87.1, 294/106, 117, 118, 112, 902

[56] References Cited

U.S. PATENT DOCUMENTS

| | | | |
|---|---|---|---|
| 2,586,843 | 2/1952 | McDonald | 294/118 X |
| 3,655,233 | 4/1972 | Twist | 294/118 |
| 3,674,302 | 7/1972 | Mutch | 294/118 |
| 3,837,699 | 9/1974 | Anderson et al. | 294/118 X |
| 3,897,969 | 8/1975 | Dike | 294/118 |

FOREIGN PATENT DOCUMENTS

| | | | |
|---|---|---|---|
| 2916597 | 11/1980 | Germany | 294/118 |
| 354564 | 4/1961 | Switzerland | 294/118 |
| 2237002 | 4/1991 | United Kingdom | 294/118 |

*Primary Examiner*—Dean J. Kramer

*Attorney, Agent, or Firm*—Lloyd L. Zickert; Adam H. Masia

[57] ABSTRACT

A device for handling railroad timber, including ties, bridge timbers, crossing planks, and bundles of ties and timbers, which comprises spaced-apart pivotally mounted gripping members or jaws for engaging longitudinally along the timber, actuating levers connected to the jaws, and a lifting harness for connecting the device to a lifting machine, such as a crane, wherein the lifting harness is connected to the actuating levers and when raised applies a force to the actuating levers and the gripping members to tightly engage the timber so it can be lifted, moved or repositioned.

32 Claims, 5 Drawing Sheets

FIG. 12
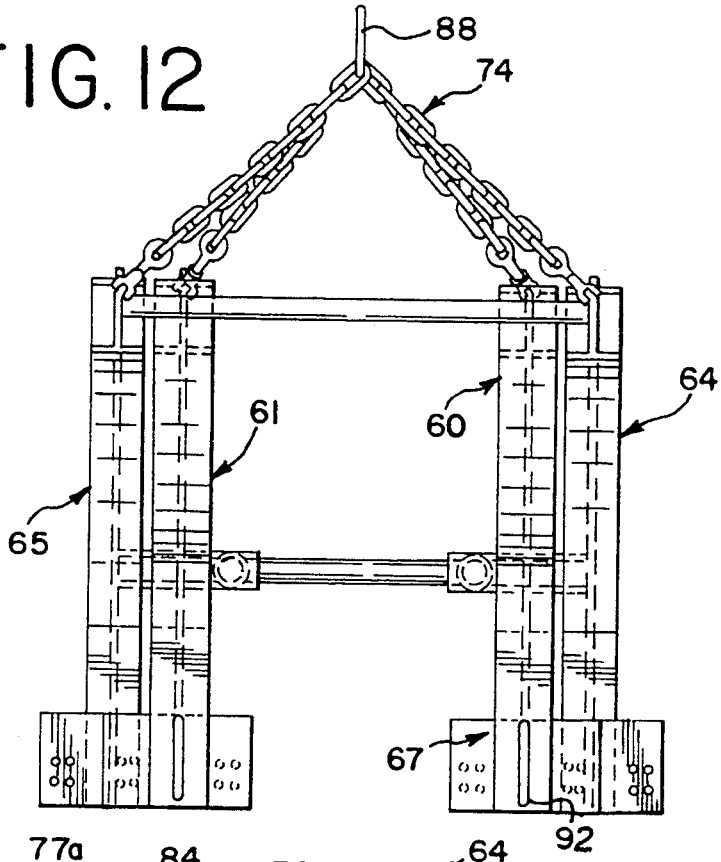
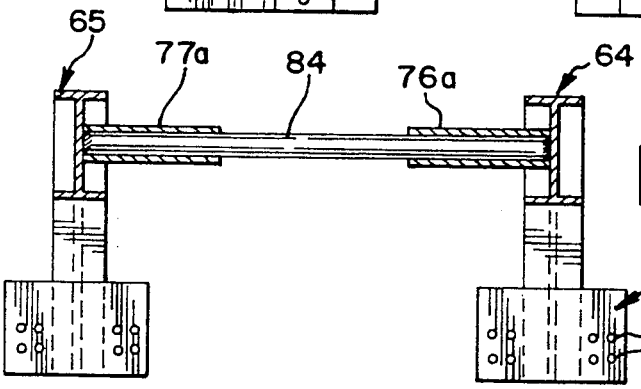
FIG. 13
FIG. 14
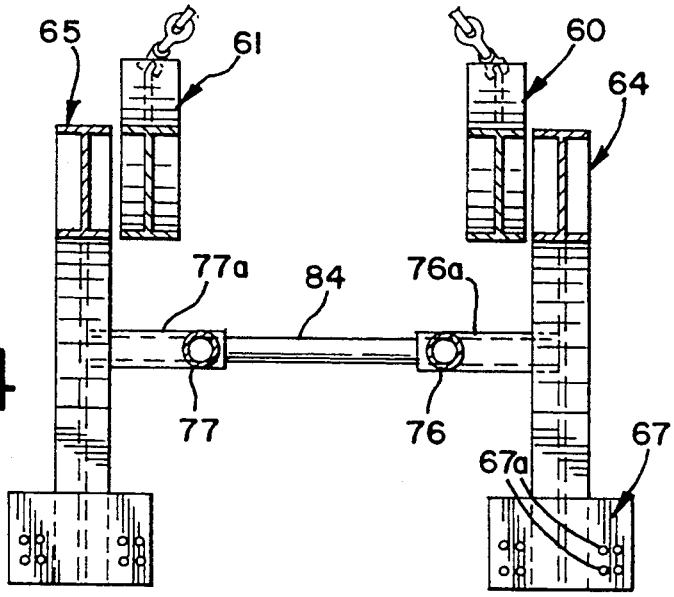

DEVICE FOR HANDLING RAILROAD TIMBER

DESCRIPTION

This invention relates in general to a device for handling railroad timber, and more particularly to a device for grippingly engaging timber including ties, planks, and the like, for lifting the timber to position it as desired during the construction or repair of a rail system, and still more particularly to a device for easily gripping and releasing timber that enhances worker safety.

BACKGROUND OF THE INVENTION

Heretofore, railroad timber, including wooden ties and planking have been handled by the use of timber tongs manipulated by persons. These tongs included single tines for engaging the timber. Such timber may include cross ties, switch ties, bridge ties, bridge timbers, and crossing planks, all of which would be too heavy for a single person to handle by himself. The usual railroad ties have heretofore been handled by use of manually operable tongs requiring at least two persons for each set of tongs. Sometimes it is necessary to use three sets of tongs and six persons in order to handle large timbers. The proximity of the persons handling the tongs with respect to the timbers is such that inadvertent slippage of the timber from the tongs can cause injury to a person or persons handling the timber. Thus, the manpower requirements for handling the timbers are labor-intensive and hazardous to the workers.

SUMMARY OF THE INVENTION

The device of the present invention overcomes the problems heretofore encountered in handling railroad timbers by enabling the safer handling of timbers and reducing the manpower needed for handling the timbers. More particularly, the device of the invention easily handles the transporting and moving of cross ties, switch ties, bridge ties, and other timbers. It also is useful to nip ties for spiking or to just pull the ties along the ground from one location to another.

The device of the present invention includes a pair of spaced-apart pivotally mounted wide gripping members or jaws for longitudinal engagement along sides of timbers, actuating levers connected to the gripping members for actuating the gripping members between gripping and non-gripping positions, and a lifting harness for connecting the levers to a lifting machine such as a crane or the like. The lifting harness is connected to the actuating levers in such a way that when a lifting force is applied to the harness, the gripping members can close to a gripping position on a timber. Conversely, relaxing the lifting force, the actuating levers can function to move the gripping members into disengaging or open position so as to allow removal of the device from a timber.

The size of the lifting device is chosen in accordance with the size of the timber being handled and particularly with respect to the width of the timber as the jaws or gripping members of the device are placed in position to engage the opposite sides of the timber. The jaws are in the form of one or more wide plates with teeth that bite into the timber.

The invention when constructed for handling a bundle of railroad ties may include a plurality of gripping members spaced so that when engaging the bundle, the bundle will be stabilized in a substantially horizontal position during lifting and moving operations.

It is therefore a object of the present invention to provide a new and improved device for handling railroad timber, such as ties and planking.

Another object of the invention is in the provision of a new and improved device for efficiently and safely handling railroad timber, and for reducing the manpower needed for handling the timber.

Still another object of the present invention is in the provision of a device for handling railroad timber including spaced-apart gripping members sized to handle a timber of predetermined width and which are closed into tight gripping relation by applying a lifting force to the device.

A further object of the invention is to provide a new and improved device for handling railroad timber which enhances worker safety and reduces manpower requirements.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 12 is a side elevational view of the device of FIGS. 9 to 11;

FIG. 13 is a vertical sectional view taken substantially along line 13—13 of FIG. 10;

FIG. 14 is a vertical sectional view taken substantially along line 14—14 of FIG. 10;

DESCRIPTION OF THE INVENTION

Figure 1:
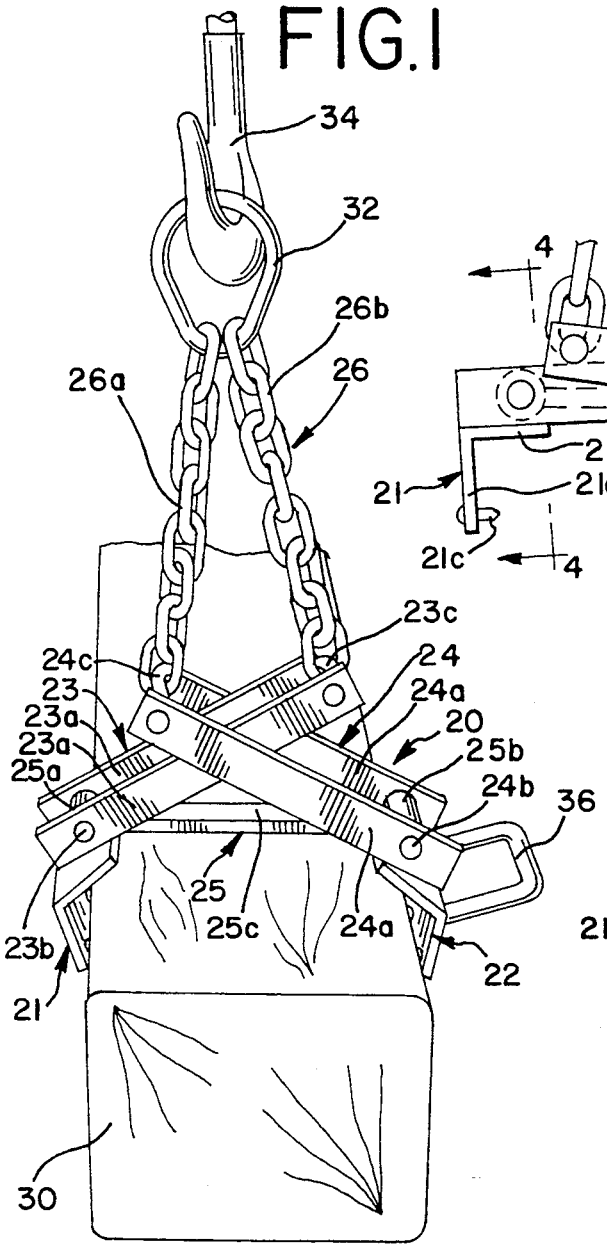
FIG. 1 is a perspective view of the railroad timber handling device of the present invention shown in gripping position on a railroad tie.

Referring now to the drawings, and particularly to the embodiment of FIGS. 1 to 6, the timber handling device of the present invention is generally indicated by the numeral 20 and includes a pair of opposed wide gripping members or jaws 21 and 22, a pair of actuating levers 23 and 24 respectively connected to the gripping members 21 and 22, a crossbar 25 for pivotally receiving at opposite ends the actuating levers and gripping members, and a lifting harness 26 connected to the actuating levers and a lifting machine (not shown). The device is made of a suitable steel providing the necessary strength to handle heavy timber.

The gripping members or jaws 21 and 22 are in the form of angle irons including generally upstanding plates or legs 21*a* and 22*a* and extending at right angles thereto generally horizontally extending plates or legs 21*b* and 22*b*. A plurality of gripping teeth 21*c* and 22*c* are mounted on the upright plates 21*a* and 22*a* respectively and extend inwardly so as to bite into a timber longitudinally along a side once the device is placed in gripping relation with the timber. In this embodiment, the teeth are welded to the lower end of the upright legs 21*a* and 22*a*. While the jaws 21 and 22 may take other configurations, they are preferably in the form of angle irons, as illustrated. The plates 21*b* and 22*b* serve to rest on the top of a timber, such as the railroad tie 30 shown in FIG. 1, prior to actuating the device into gripping relation with the timber, and the upstanding plates 21*a* and 22*a* extend down the opposite sides of the railroad tie 30 so that when they close or move into gripping relation, the teeth 21*c* and 22*c* can bite into the side walls of the railroad tie.

Figure 7:
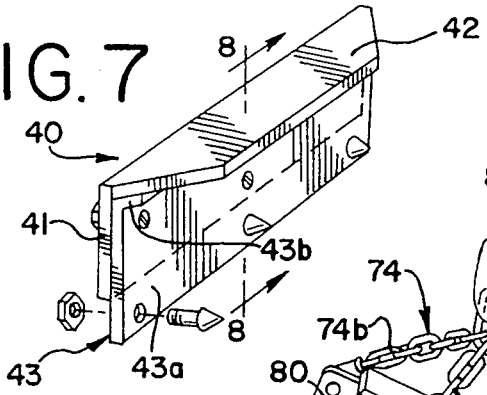
FIG. 7 is an enlarged perspective view of a modified gripping member.
Figure 8:
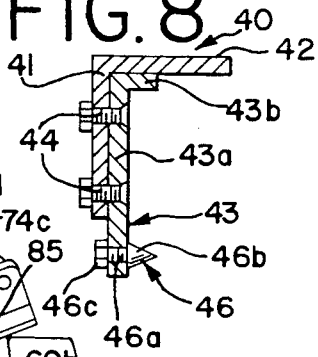
FIG. 8 is an enlarged vertical sectional view taken substantially along line 8—8 of FIG. 7.

Connected to the gripping members 21 and 22 for purposes of actuating the gripping members are the actuating levers 23 and 24, each of which consists of respectively a pair of bars 23*a* and 24*a*. At the ends of the bars adjacent the gripping members, the bars are connected together by shafts 23*b* and 24*b* respectively, while at the other ends of the bars, they are connected together by pins 23*c* and 24*c*. Both the shafts and the pins are suitably secured to the bars such as by welding. The bars themselves are suitably secured to the gripping members such as by welding. In the embodiment of FIGS. 1 to 6, the teeth 21*c* and 22*c* are welded to the gripping members as above noted, but they may be replaceably secured to the gripping members, as shown in the embodiment of FIGS. 7 and 8 and described below.

The shafts 23*b* and 24*b* are pivotally received in sleeve bearings 25*a* and 25*b* respectively which are part of the crossbar 25 and suitably secured such as by welding to opposite ends of the bar 25*c*. Thus, gripping members and actuating levers are pivotally or rotationally mounted at opposite ends of the crossbar 25. The length of the crossbar is such as to appropriately position the gripping members for proper gripping and handling of a railroad timber of a particular width. For example, one size would best fit ties of one width, and another larger size would best fit planking of a greater width or ties of a greater width.

Figure 2:
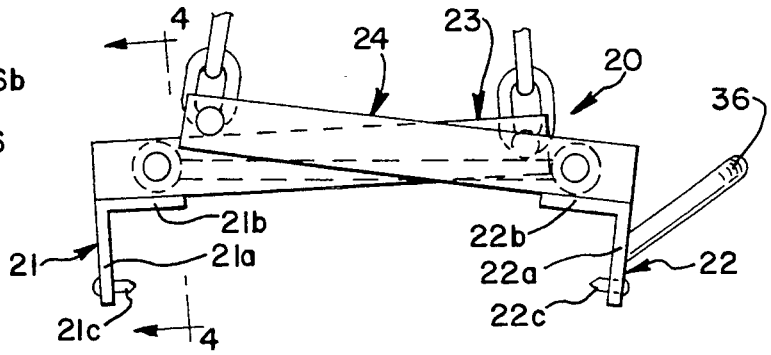
FIG. 2 is a side elevational view of the device of FIG. 1 with a part of the lifting harness broken away for purposes of clarity.
Figure 4:
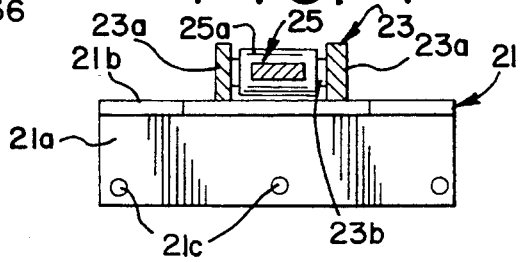
FIG. 4 is a detailed sectional view taken substantially along line 4—4 of FIG. 2.
Figure 3:
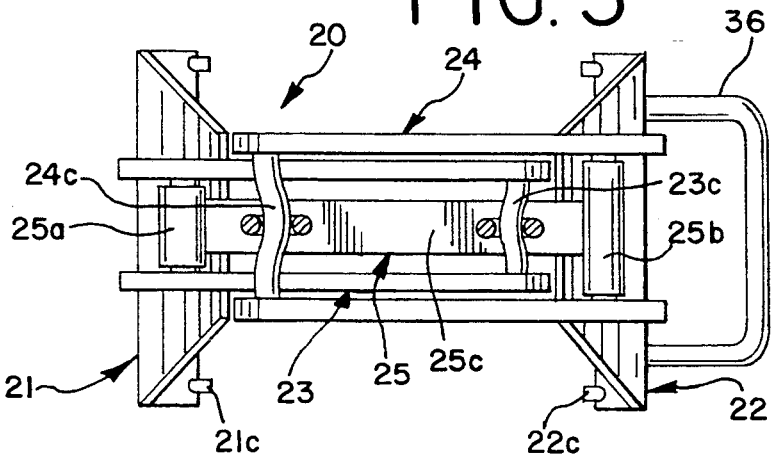
FIG. 3 is a top plan view of the timber handling device of FIG. 1 with the lifting harness chains removed to show underlying parts.
Figure 5:
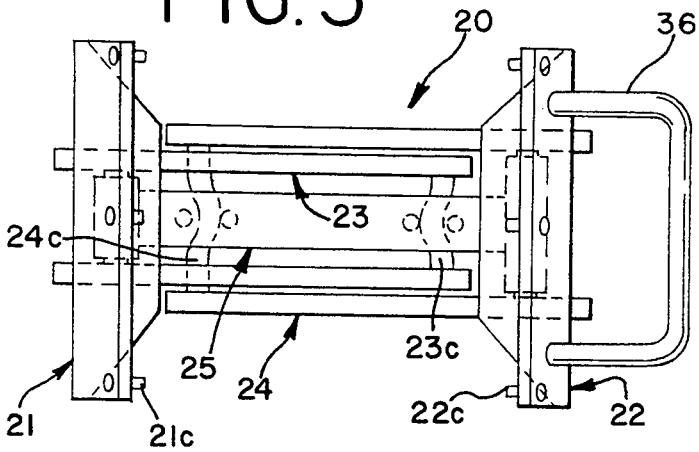
FIG. 5 is a bottom plan view of the timber handling device.
Figure 6:
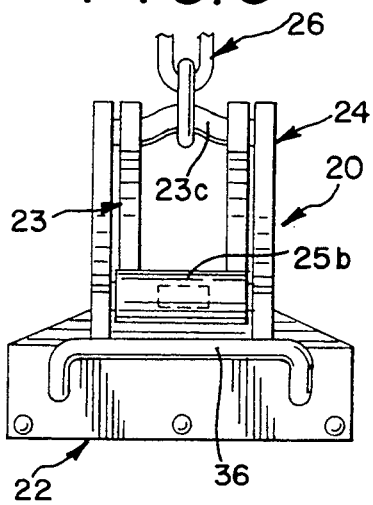
FIG. 6 is an end elevational view of the device with the lifting harness broken away.

The actuating levers are of such a length that they cross one another to provide the best possible leverage in such a compact device. Further, the spacing of the bars 23*a* of the actuating lever 23 is less than the spacing between the bars 24*a* of the actuating lever 24, so that the actuating lever 23 can intermesh and fit within the actuating lever 24 between bars 24*a* in the crossing fashion as illustrated in FIGS. 1 and 2 to produce optimum leverage. The length of the actuating levers is further such that upon applying a uniform lifting force to the lifting ends of the levers, a gripping force will be transmitted to the gripping members to grip the timber. As the lifting force increases, the gripping action increases in relation to the weight of the timber.

The lifting harness 26 includes chain lengths 26*a* and 26*b*. The lower end of chain length 26*a* is connected to the pin 24*c* of the actuating lever 24, while the lower end of the chain length 26*b* is connected to the pin 23*c* of the actuating lever 23. The upper ends of both chain lengths 26*a* and 26*b* are connected to a lifting ring 32 that in turn is received on a lifting hook 34 of a lifting machine such as a crane, which is not shown.

In operation, the timber handling device of the invention would be manipulated in place onto a timber such as the railroad tie 30 with the gripping members in open position and the actuating levers more nearly parallel to each other, as seen in FIG. 2. In order to facilitate the placement and safe handling of the device, a handle 36 is mounted on one of the gripping members and in this case on the gripping member 22. Following the placement of the wide gripping members on a timber, a lifting force is applied through the lifting harness which causes rotation or pivotal movement of the actuating levers and gripping jaws so that the teeth come into contact with the sides of the timber to grippingly connect the device to the timber. Thereafter, the lifting device or crane can easily move the timber from one location to another as desired. Only a single person need be provided to operate the lifting device of the invention and to thereafter stabilize, if necessary, the timber during its movement between locations. Upon reaching the proper location, the lifting machine lowers the timber and lifting device, and relaxes the lifting harness to allow the gripping members to be easily opened for removal of the lifting device from the timber. In order to remove the timber handling device from a timber once the lifting force has been removed from the lifting harness, a person can grasp the handle 36 to assist in disengaging the device from a timber and allowing it to be removed for further use in connection with another timber-handling operation. Accordingly, only a single person is needed to operate the lifting device and manipulate it relative to a timber during the transporting of the timber between locations.

A modified gripping member or jaw is shown in FIGS. 7 and 8 and generally indicated by the numeral 40. This jaw includes an angle iron having a vertical plate or leg 41 and a horizontal plate or leg 42. Additionally, an extension 43 is provided to lengthen the leg 41 so that when the gripping member 40 is placed in relation to a timber, the vertical leg of the gripping member will extend further down the side of the timber to place the teeth lower on the side of a timber. This feature is especially useful for worn timbers having rounded corners. As seen in FIGS. 7 and 8, the extension 43 includes a vertical leg 43*a* and a short horizontal leg 43*b*. The extension member is placed in relation to the vertical leg 41 and the horizontal leg 42 so that it mates as shown in FIG. 8 and is then secured in place by suitable fasteners 44.

This modified gripping member also differs in that it includes replaceable teeth 46. These teeth include a shank 46*a* having a pointed head 46*b* on one end defining a shoulder with the shank so that when inserted into a hole formed in the extension 43, the shoulder will bear against the inner surface of leg 43*a*. The shank 46*a* includes threads for receiving a nut 46*c* for securing the replaceable tooth on the extension 43. Thus, when the tooth becomes worn to the point that it no longer will serve well to bite into a timber, it can easily be replaced by unscrewing the nut 46*c* and removing the worn tooth from the extension 43 and replacing with a new tooth. Preferably, replaceable teeth are used with the present invention in order to provide the option of easily replacing worn teeth. Moreover, it should be appreciated that the gripping member 40 may be made so that the vertical leg 41 is long enough to avoid the need to add an extension. Also, it should be appreciated that an extension of various sizes could be provided for easily converting the gripping member to have a vertical leg of a desired length on the gripping jaw.

As above mentioned, it will be appreciated that the timber handling device of the invention may be made in different sizes depending upon the actual size of timber to be handled. Further, where it may be desired to handle bundles of timber units such as ties, the present invention may be incorporated into a bundle handling device, as shown in FIGS. 9 to 15. This bundle handling device is generally indicated by the numeral 50 and differs from the timber handling device of FIGS. 1 to 6 in that it is structurally stronger and wider to provide widely spaced apart gripping members for gripping a bundle of timbers, as indicated at 51 in FIG. 9.

More specifically, the bundle 51 is a bundle of railroad ties held together by steel strapping members 54 and 55. The bundle handling device 50 includes dual-actuating levers and gripping jaws spaced to produce a gripping connection with a bundle of ties along the longitudinal axis of the tie bundle such that when actuated will facilitate a uniform grip on the bundle that it will be substantially balanced in a horizontal mode when lifted and suspended in air. The bundle handling device includes generally crossbar means 58, inner actuating levers 60 and 61 pivotally mounted at one end of the crossbar means 58, outer actuating levers 64 and 65 pivotally mounted at the other end of the crossbar means 58, timber-gripping plates 66 and 67 for the actuating levers 60 and 61 and timber-gripping plates 70 and 71 for the actuating levers 64 and 65, and a lifting harness 74.

The crossbar means 58 includes spaced crossbars 76 and 77, each of which has at its opposite ends sleeve bearings 76*a*, 76*b*, 77*a* and 77*b*.

The inner actuating arms 60 and 61 include I-beam vertical legs 60*a* and 61*a* interconnected to upwardly slanting I-beam legs or bars 60*b* and 61*b*. Gripping plates 66 and 67 are connected at the lower end of the vertical legs 60*a* and 61*a*, while the lifting harness 74 is connected to the free ends of the upper I-beam bars 60*b* and 61*b*. The actuating levers 60 and 61 are interconnected near the intersection of the vertically and upwardly slanting bars by a cross shaft 79 which is journaled in the sleeve bearings 76*b* and 77*b* of the crossbars 76 and 77. A further interconnecting crossbar 80 extends between the upper free ends of the upwardly slanting legs 60*b* and 61*b*. Both the shaft 79 and the reinforcing crossbar 80 are suitably welded to the actuating levers 60 and 61.

Similarly, the outer actuating levers 64 and 65 include vertical legs 64*a* and 65*a* and upwardly slanting legs 64*b* and 65*b*. A cross shaft 84 is connected between the actuating levers adjacent the upper end of the vertical legs 64*a* and 65*a*, while a reinforcing crossbar 85 interconnects between the upper free ends of the upper legs 64*b* and 65*b*. Further, the cross shaft 84 is pivotally journaled in the tubular bearings 76*a* and 77*a*. The gripping plates 70 and 71 are fastened to the inner sides of the vertical legs 64*a* and 65*a*. To enhance the gripping of the gripping plates with the sides of the tie bundle, gripping teeth are provided on each of the gripping plates in the form of teeth 66*a*, 67*a*, 70*a* and 71*a*. The teeth may be welded to the plates, or of the easily replaceable type shown in FIGS. 7 and 8.

At the upper free ends of the upper legs 64*b* and 65*b* and the legs 60*b* and 61*b*, suitable connectors are provided for connecting the lifting harness to the actuating levers. The lifting harness 74 includes four strands or lengths of chain 74*a*, 74*b*, 74*c* and 74*d*. The upper ends of the chain lengths are commonly connected to a lifting ring 88 which in turn is hooked to a lifting hook 89 of a lifting machine such as a crane. The lower ends of the chain lengths are connected to the upper free ends of the actuating levers. The lower end of chain length 74*a* is connected to the upper leg 61*b*, while the chain length 74*b* is connected to the upper leg 60*b*. Similarly, chain lengths 74*c* and 74*d* are respectively connected to the free ends of the upper legs 64*b* and 65*b*.

Further, in order to facilitate the handling of the tie bundle carrier and the removal from a bundle of ties in a safe manner, handles are provided at the outer lower ends of each of the vertical legs of the actuating members. Handles 92, 93, 94 and 95 are respectively connected to the outer lower ends of the vertical legs of the actuating levers 60, 61, 64 and 65, respectively. These handles facilitate the manipulation of the tie bundle carrier and also the removal of the carrier once it has served to carry a bundle to a desired location.

In operation, the tie bundle carrier 50 may be arranged on a tie bundle in non-gripping position at a time when the lifting harness is relaxed. Thereafter, applying a lifting force to a lifting harness pulls the upper free ends of the actuating levers to pivot the levers in relation to crossbar means 58 to place the gripping plates into gripping relation with the sides of the tie bundle such that the teeth bite into the bundle. Thereafter, further lifting force will continue to strengthen the gripping action and allow the entire bundle of ties to be lifted and moved to a desired location. Upon reaching a desired location with the lifting force released, the actuating levers can then be disengaged from the tie bundle and the bundle carrier can be removed for a further operation.

Figure 9:
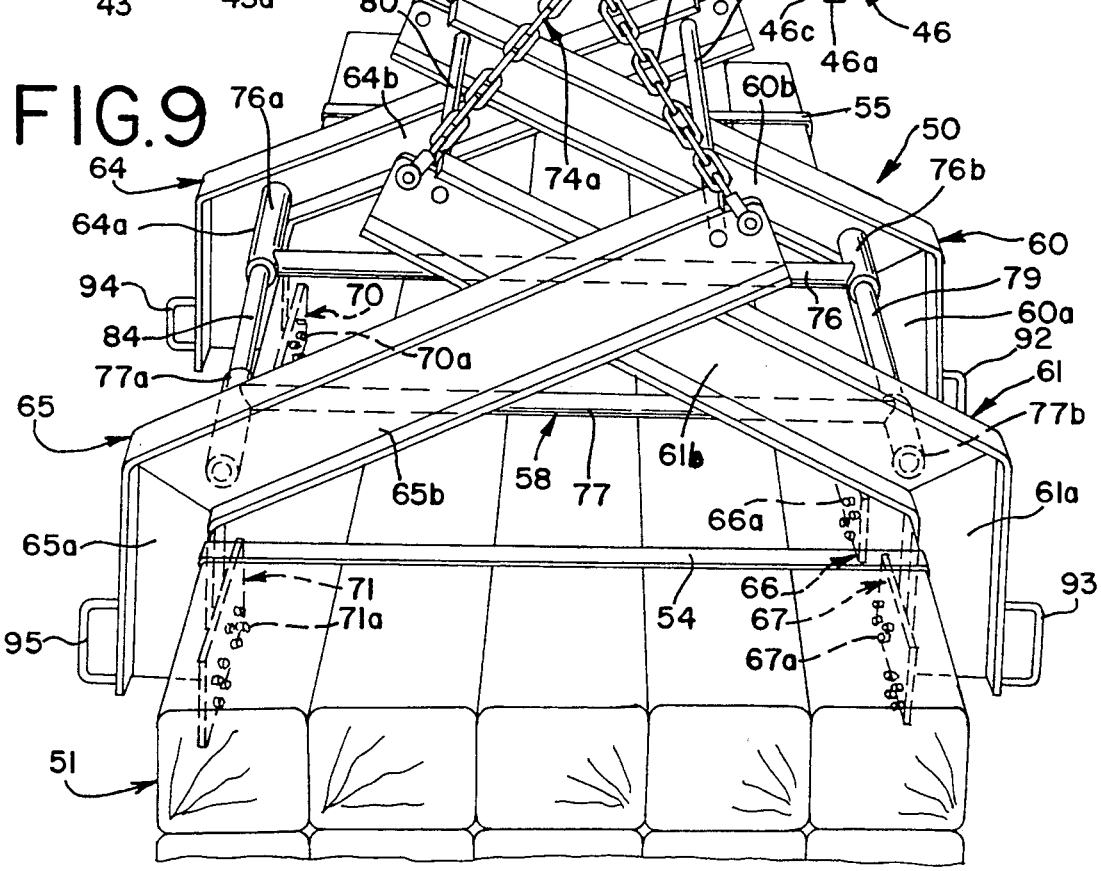
FIG. 9 is a perspective view of a modified timber handling device according to the invention that is particularly useful in handling a bundle of railroad ties.
Figure 10:
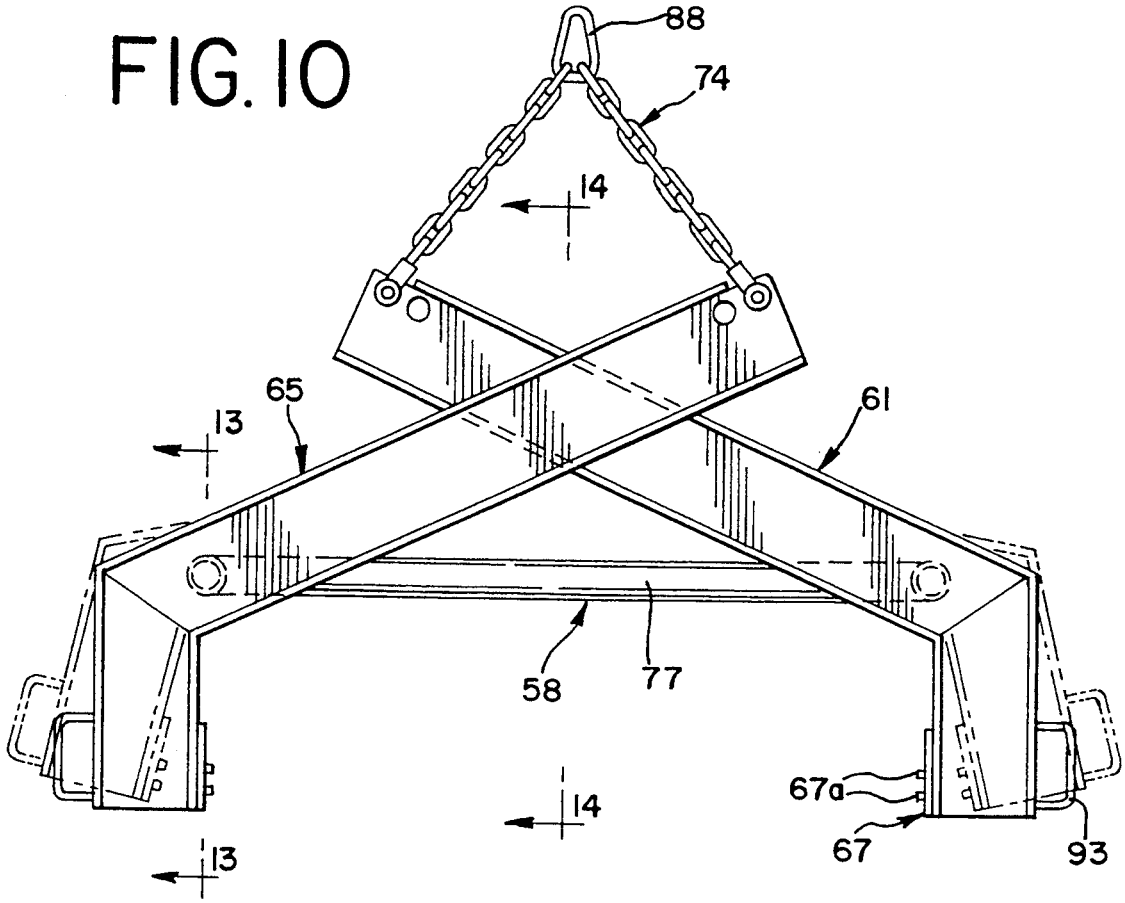
FIG. 10 is an end elevational view of the device of FIG. 9 showing the device in closed position in solid and the jaws of the device in open position in phantom.
Figure 11:
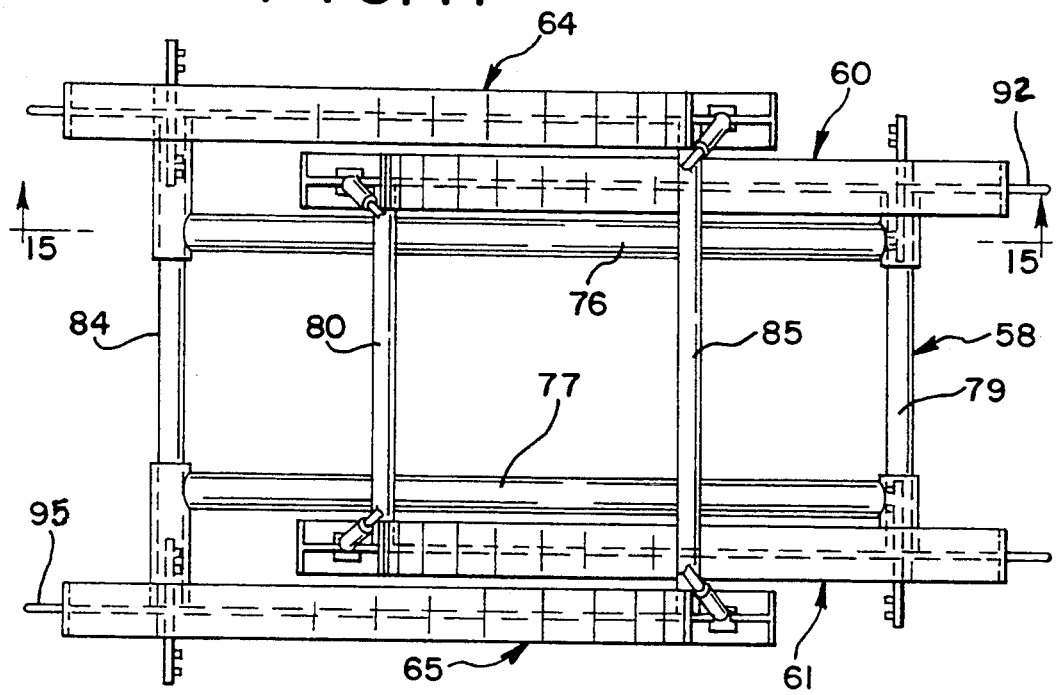
FIG. 11 is a top plan view of the device of FIGS. 9 and 10 with a part of the lifting harness removed for purposes of clarity.
Figure 15:
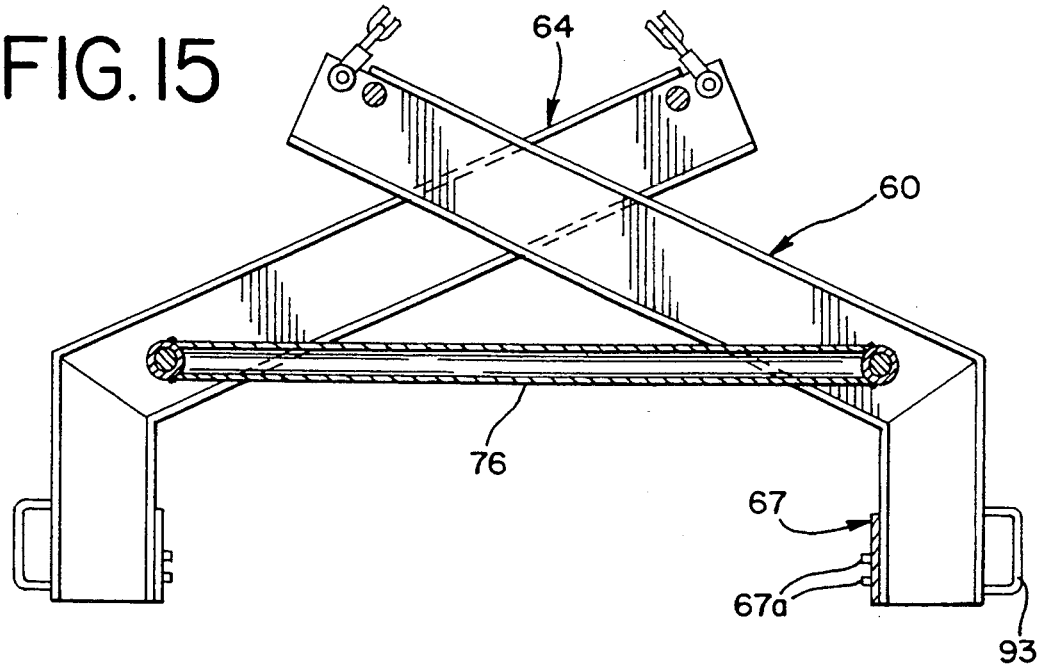
FIG. 15 is a longitudinal sectional view taken substantially along line 15—15 of FIG. 11.
Figure 16:
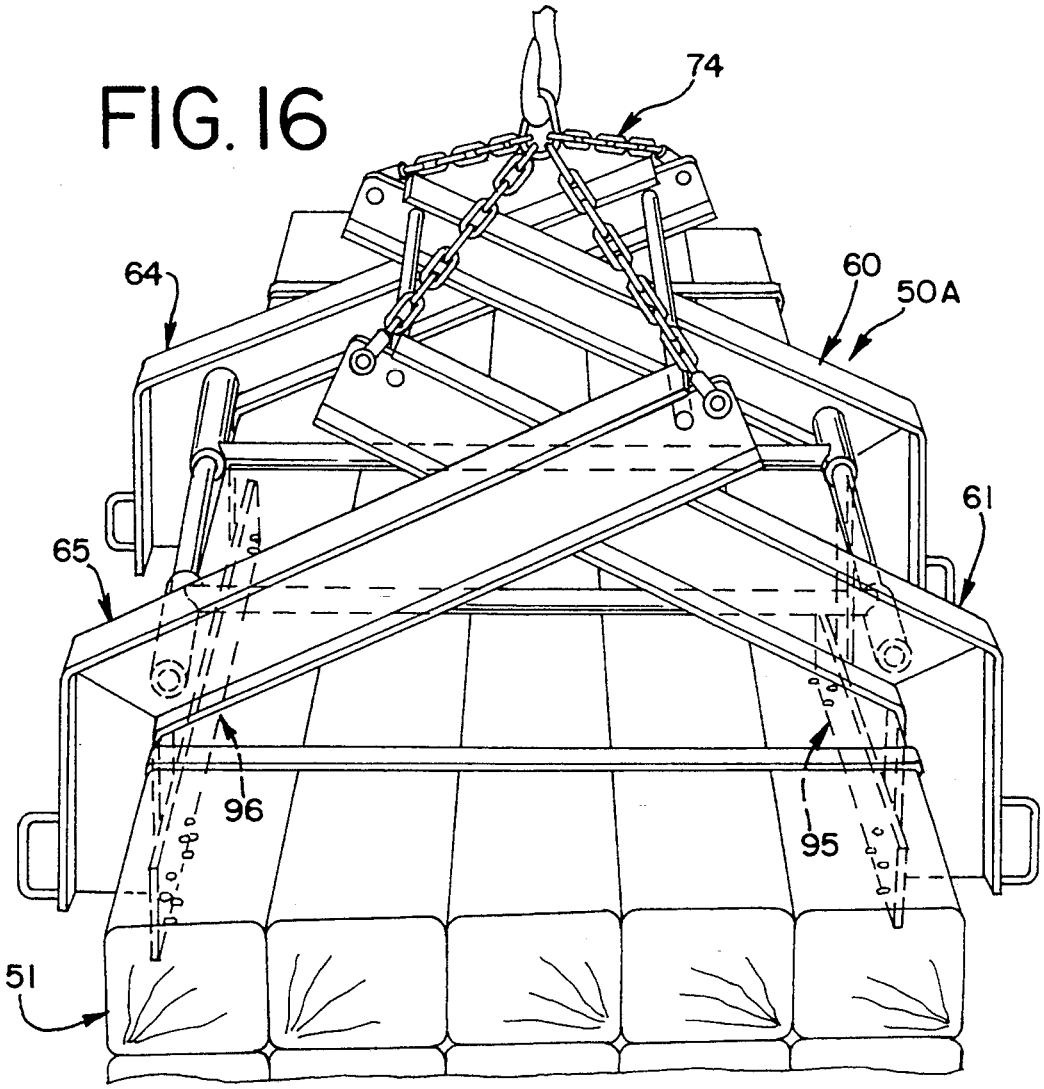
FIG. 16 is a perspective view of a modification of the device of FIGS. 9 to 15, wherein a single jaw member is provided for each of the two actuating levers.

Referring now to FIG. 16, a modified tie bundle carrier 50A is shown and which differentiates from the tie bundle carrier of FIG. 9 in that the inner and outer actuating levers are provided with single gripping plates rather than plural gripping plates. Where applicable, like numerals are applied to the tie bundle carrier of FIG. 16 for purposes of simplicity. The inner actuating levers 60 and 61 are shown to include a single gripping plate 95 with a suitable number of gripping teeth, while the outer actuating levers 64 and 65 are shown to include a single gripping plate 96 which is interconnected between the two actuating levers. Otherwise, this tie bundle carrier is the same as tie bundle carrier 50 and operates in the same manner.

In view of the foregoing, it may be appreciated that the present invention provides a new and improved device for handling railroad timber in single pieces or in bundle form which is more efficient and which enhances worker safety.

It will be understood that modifications and variations may be effected without departing from the scope of the novel concepts of the present invention, but it is understood that this application is to be limited only by the scope of the appended claims.

The invention is hereby claimed as follows:

1. A device for handling railroad timber having top, bottom, and side walls, said device comprising crossbar means having pivot means at each end, a pair of inner actuating levers, a pair of outer actuating levers, one of said pair of levers pivoted adjacent one end at one of the pivot means and the other of said pair of levers pivoted adjacent one end at the other of said pivot means, gripping means at the ends of said levers on the ends adjacent the pivot means at one side of the pivot means, handle means attached to at least one of said gripping means, said levers extending to the other side of the pivot means such that the levers cross each other and provide a mechanical advantage in pivoting the gripping means, and a lifting harness connected to the ends of the levers opposite the gripping means, whereby application of a lifting force to said harness will cause pivoting of said actuating levers to close said gripping means into gripping relation with said side walls of said railroad timber and release of said lifting force and application of a pulling force on said handle means will assist in disengaging the device from said railroad timber and allowing the device to be removed from the timber.

2. The device of claim 1, wherein the railroad timber is one of a cross, switch or bridge tie, a bridge timber, a crossing plank, or a bundle of ties, said gripping means including wide jaws having teeth thereon to engage longitudinally along the timber, and the crossbar means being of a length to horizontally space the jaws for engaging said side walls of said railroad timber.

3. The device of claim 2, wherein a single jaw is connected to each pair of levers.

4. The device of claim 3, wherein the lifting harness includes first and second lengths of chain, one end of one chain length being connected to one pair of levers and one end of the other chain length connected to the other of said pair of levers, and the other ends of the chain lengths being connected to a common lifting ring to which a lifting machine can be connected for application of a lifting force.

5. The device of claim 2, wherein a jaw is connected to each of the levers.

6. The device of claim 5, wherein said levers are connected to pivot together relative to the crossbar means, and said lifting harness includes first, second, third and fourth lengths of chain, one end of each chain length connected to one of the levers, the other ends of each chain length connected to a common lifting ring to which a lifting machine can be connected for application of a lifting force.

7. The device of claim 1, wherein the railroad timber is one of a cross, switch or bridge tie, a bridge timber, a crossing plank, or a bundle of ties, and the lifting harness includes plural lengths of chain, each chain length connected at one end to one of the actuating levers and at the other end to a common ring to which a lifting machine can be connected for application of a lifting force.

8. The device of claim 1, wherein the railroad timber is one of a cross, switch or bridge tie, a bridge timber, a crossing plank, or a bundle of ties, and the gripping means includes jaws formed by angle irons each including a top plate and a side plate, and teeth on the side plate for engaging longitudinally along said side wall of the timber, wherein the top plate of each jaw serves to engage said top wall of the timber and control the location of the side plate teeth on the side wall of the timber to safely engage the side wall of the timber.

9. The device of claim 8, wherein the teeth are welded to the side plates.

10. The device of claim 8, wherein the teeth are removably mounted on the side plates.

11. A device for handling a railroad tie for use in combination with a lifting machine, said tie having top, bottom, and side walls, said device comprising: a crossbar means having bearings at each end, a first actuating lever means pivotally mounted in a bearing at one end of said crossbar means, a second actuating lever means pivotally mounted in a bearing at the other end of said crossbar means, a first gripping jaw carried by said first actuating lever means, a second gripping jaw carried by said second actuating lever means, said gripping jaws having means for engaging the side walls of the tie along longitudinal areas thereof and means for engaging said top wall of said railroad tie when placing said device on said tie prior to handling said tie to correctly position the gripping jaws, said actuating lever means including long arms crossing each other, and a lifting harness connected to the free ends of said arms and to the lifting machine, whereby application of a lifting force by said lifting machine causes said actuating lever means to close the first and second gripping jaws into gripping engagement with the side walls of said tie.

12. The device of claim 11, wherein the crossbar means is of a length to horizontally space the gripping jaws for optimum gripping engagement with the side walls of the tie.

13. The device of claim 11, wherein teeth are mounted on the gripping jaws.

14. The device of claim 11, wherein said means for engaging the side walls of the tie include an elongated plate having a plurality of teeth for engaging the side walls of the tie.

15. The device of claim 14, wherein said means for engaging the top wall of said tie includes upwardly slanting legs attached to said first and second gripping jaws.

16. The device of claim 11, wherein said means for engaging the top and side walls of said tie are formed by angle irons each including a top plate and a side plate, and teeth on the side plate for engaging longitudinally along the side walls of the tie, wherein the top plate of each jaw serves to engage the top wall of the tie and control the location of the side plate teeth on the side walls of the tie to safely engage the side walls of the timber tie.

17. The device of claim 11, wherein the lifting harness includes first and second lengths of chain, one end of one chain length being connected to the free end of one of said arms, one end of the other of said chain lengths being connected to the free end of the other of said arms, the other ends of said chain lengths being connected to a ring that is connected to the lifting machine.

18. The device of claim 11, wherein both said actuating lever means include a pair of interconnected and spaced apart arms with one of said pair being disposed between the other of said pair.

19. The device of claim 18, wherein said first gripping jaw is connected to both arms of said first actuating lever means, and said second gripping jaw is connected to both arms of said second actuating lever means.

20. The device of claim 11, which further includes handle means attached to at least one of said first and second gripping jaws, whereby release of the lifting force and application of a pulling force to said handle means will assist in disengaging said device from said railroad tie and allowing the device to be removed from the tie.

21. A device for handling a bundle of railroad ties in combination with a lifting machine, said tie bundle having top, bottom, and side walls, said device comprising: a generally horizontally extending crossbar means having bearing means at each end, a first actuating lever means pivotally mounted in the bearing means at one end of the crossbar means, a second actuating lever means pivotally mounted in the bearing means at the other end of the crossbar means, a first gripping jaw means carried by said first actuating lever means, a second gripping jaw means carried by said second actuating lever means, both said gripping jaw means being formed to engage the side walls of said tie bundle along longitudinal areas thereof, handle means attached to at least one of said first and second gripping jaw means, said actuating lever means including long arms crossing each other, and a lifting harness connected to the free ends of said arms and to the lifting machine, whereby application of a lifting force by the lifting machine causes said actuating lever means to close the gripping jaw means into gripping engagement with the side walls of the tie bundle and release of said lifting force and application of a pulling force on said handle means assists in disengaging the device from the side walls of the tie bundle and allowing the device to be removed from the tie bundle.

22. The device of claim 21, wherein each said gripping jaw means includes a plurality of plates with teeth mounted thereon.

23. The device of claim 22, wherein the teeth are welded to the plates.

24. The device of claim 22, wherein the teeth are removably mounted on the plates.

25. The device of claim 21, wherein each said gripping jaw means includes a single plate with teeth mounted thereon.

26. The device of claim 25, wherein the teeth are welded to the plates.

27. The device of claim 25, wherein the teeth are removably mounted on the plates.

28. The device of claim 21, wherein the first and second actuating lever means each include a pair of interconnected arms pivotally mounted on the crossbar means.

29. The device of claim 28, wherein the lifting harness includes a plurality of chain lengths each connected at one end to a lifting ring and connected at the other end to one of the arms.

30. A device for handling railroad timber having top, bottom, and side walls, said device comprising crossbar means having pivot means at each end, a pair of inner actuating levers, a pair of outer actuating levers, one of said pair of levers pivoted adjacent one end at one of the pivot means and the other of said pair of levers pivoted adjacent one end at the other of said pivot means, gripping means attached to said levers on the ends adjacent the pivot means at one side of the pivot means, said gripping means including means for engaging the side walls of said timber and further including means for engaging the top wall of said timber when placing said device on said timber prior to handling said timber to correctly position the gripping means, said levers extending to the other side of the pivot means such that the levers cross each other and provide a mechanical advantage in pivoting the gripping means, and a lifting harness connected to the ends of the levers opposite the pivot means, whereby application of a lifting force to said harness will cause pivoting of said actuating levers to close said gripping means into gripping relation with said sides of said railroad timber.

31. The device of claim 30, wherein the railroad timber is one of a cross, switch or bridge tie, a bridge timber, a crossing plank, or a bundle of ties, said means for engaging the side walls of said timber include wide jaws having teeth thereon to engage longitudinally along the side walls of the timber, and the crossbar means being of a length to horizontally space the jaws for engaging the side walls of said railroad timber.

32. The device of claim 30, which further includes handle means attached to at least one of said gripping means whereby application of a pulling force to said handle means will assist in disengaging the device from said railroad timber and allowing the device to be removed from the timber.

* * * * *